United States Patent [19]

Coffee

[11] Patent Number: 4,659,012

[45] Date of Patent: Apr. 21, 1987

[54] ELECTROSTATIC SPRAYING PROCESS AND APPARATUS

[75] Inventor: Ronald A. Coffee, Fernhurst, Nr. Haslemere, Great Britain

[73] Assignee: Imperial Chemical Industries plc, London, England

[21] Appl. No.: 726,891

[22] PCT Filed: Aug. 14, 1984

[86] PCT No.: PCT/GB84/00282

§ 371 Date: Apr. 17, 1985

§ 102(e) Date: Apr. 17, 1985

[87] PCT Pub. No.: WO85/00761

PCT Pub. Date: Feb. 28, 1985

[30] Foreign Application Priority Data

Aug. 18, 1983 [GB] United Kingdom ..... 8322307
Aug. 6, 1984 [GB] United Kingdom ..... 8420015

[51] Int. Cl.[4] ..... B05B 5/02
[52] U.S. Cl. ..... 239/3; 239/690
[58] Field of Search ..... 239/3, 690, 691, 704–708

[56] References Cited

U.S. PATENT DOCUMENTS 2,894,175 7/1959 Lamm .
4,157,162 6/1979 Benedek et al. ..... 239/707
4,264,641 4/1981 Mahoney et al. .

FOREIGN PATENT DOCUMENTS 7600132 6/1977 Fed. Rep. of Germany .
2358207 2/1978 France .
2423271 11/1979 France .

*Primary Examiner*—Andres Kashnikow
*Attorney, Agent, or Firm*—Cushman, Darby & Cushman

[57] ABSTRACT

An apparatus for the electrostatic spraying of liquids, especially aqueous liquids, includes a sprayhead chargeable to a high electrical potential and at least one electrode having a sharp edge or point. The electrode is so arranged and is maintained at such a potential that the generally radially directed electrical forces acting upon the surface of a liquid emerging from the sprayhead are reduced. The liquid then assumes a ligamentary form prior to atomization.

10 Claims, 3 Drawing Figures

ELECTROSTATIC SPRAYING PROCESS AND APPARATUS

This invention relates to electrostatic spraying, especially spraying of aqueous liquids and agricultural chemicals.

It has been proposed to spray liquids by atomising from a sprayhead charged to a high potential. Such a process is described in our U.K. Pat. No. 1 569 707. It has been found in practice that satisfactory atomisation at practical flow-rates can be achieved with oil-based liquids but that for reasons which are not completely understood satisfactory atomisation of aqueous formulations tends to occur only at flow-rates which are undesirably low for many purposes.

It has been observed that satisfactory spraying of oil-based formulations tends to be associated with the formation of at least one stable ligament of liquid which is ejected from the sprayhead under electrostatic forces and which breaks up into droplets at a distance from the sprayhead. Such ligamentary flow is not characteristically obtained with aqueous liquids and it is believed (although the utility of the present invention does not depend upon the correctness of the theory) that this absence of ligamentary flow may be a cause of the unsatisfactory spraying characteristics of such liquids.

We have now found that under some circumstances it is surprisingly possible to achieve ligamentary flow and satisfactory spraying characteristics with a wider range of liquids than heretofore including aqueous liquids.

According to the present invention there is provided apparatus for the electrostatic spraying of liquids, comprising a sprayhead which is chargeable to a high electrical potential so that, in use, liquid is projected from the sprayhead under the influence of electrostatic forces, at least one electrode having a sharp edge or point, and means for maintaining the said at least one electrode at an electrical potential, the arrangement of the said at least one electrode and the potential being such as to reduce the generally radially directed electrical forces acting upon the surface of liquid prior to its atomisation into droplets, whereby the liquid assumes a ligamentary form.

According to the invention there is also provided a process for electrostatic spraying of liquids, comprising delivering the liquid to a sprayhead charged to a high electrical potential so that liquid is projected from the sprayhead under the influence of electrostatic forces, and reducing the strength of the generally radially directed electrical forces acting upon the surface of the liquid after it leaves the sprayhead but prior to its atomisation into droplets, whereby the liquid assumes a ligamentary form.

The region over which one or more ligaments are formed may be thought of as a ligamentary zone although of course in the absence of the special measures which characterise the present ligaments are not formed over the whole desired range of spraying conditions according to our observations.

The extent of the ligamentary zone will vary according to operating parameters but can be determined by practical trial.

The strength of the electrical forces to which the surface of the liquid is subjected in the ligamentary zone may be decreased, according to one aspect of the present invention, by passing the liquid past one or more sharp or pointed electrodes maintained at earth potential or a potential relatively low compared with that of the sprayhead. Alternatively, such electrodes may be electrically charged to a high-potential of opposite polarity to the nozzle. We have found that selection of conditions which influence forces at the surface of the liquid is especially effective in achieving ligamentary flow.

The invention will now be described, by way of example, with reference to the accompanying drawings, in which.

Figure 1:
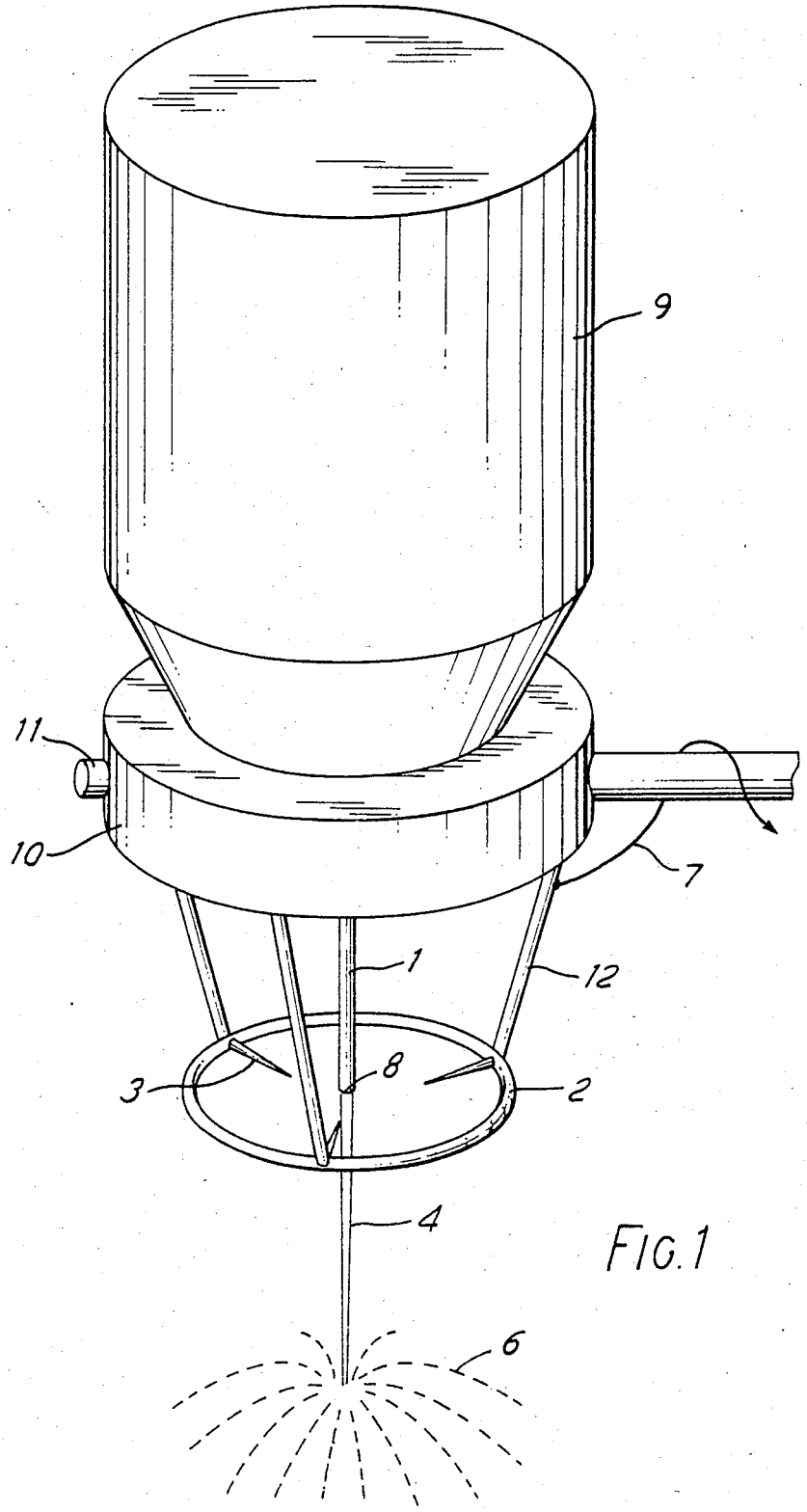
FIG. 1 is a diagrammatic perspective view of an apparatus according to the invention for spraying an aqueous liquid.

Referring to FIG. 1 of the drawings, one embodiment of the invention is a spraying apparatus having an inverted container 9 of thermoplastics material and a sprayhead including a narrow metal tube 1 which is fitted into an outlet at a lower end of the container. Both the container 9 and the tube 1 are supported by a plastics holder 10.

The tube 1 has an external diameter of 0.5 mms. and an internal diameter of 0.4 mms. and is electrically connected to a high voltage connector 11 on the holder 10. The connector 11 is adapted to connect the tube 1 to a positive terminal of a high voltage source (not shown) which generates a voltage of 15.0 kilovolts.

Adjacent an outlet 8 of the tube 1 is a conductive ring 2, which is supported below the holder 10 by three metal support arms 12 and connected to earth potential via an earth wire 7. The ring 2 is disposed coaxially of the tube 1 at an axial location corresponding to the axial location of the outlet 8. Three equiangularly spaced, needle-shaped projections are formed on the ring 2, each projection pointing in a direction having a component extending radially inwardly of the ring and a small downstream component. The ring 2 has a diameter of appoximately 5 cms. and is made from wire of 2 to 3 mms. diameter. Each projection 3 is 1 cm. long.

In use, the container 9 is filled with distilled water which is delivered from the container to the tube 1 at a flow rate of about 0.2 ml./sec or below and issues from the outlet 8 of the tube. The voltage source is switched on, so that a potential of 15.0 kilovolts is applied to the tube 1, and the ring 2 and the projections 3 are maintained at earth potential.

As the water emerges from the outlet 8 of the tube 1 it is formed into a ligament or column 4, which extends downwardly from the outlet over a distance of 0.5 to 3 cms. The ligament or column 4 has a diameter which decreases from approximately 0.4 mms. at an upper end of the column to approximately 0.1 mms. at a lower end thereof. At the lower end, the water in the ligament 4 is atomised into droplets 6, which are projected outwardly in a generally radial direction. The droplets have a volume median diameter of the order of 10 to 50 um.

In the absence of the projections 3, no ligaments are formed and only very irregular atomisation takes place at the above-mentioned flow rate.

The precise mechanism of the effect produced by the projections 3 is not completely understood.

However, it has been noted that a ring-shaped field-intensifying electrode which does not have a point or sharp edge and which has a diameter of about 2 cms. (as described in the above-mentioned specification U.K. Pat. No. 1 569 707) does not produce regular atomisation of water or aqueous solutions. Instead, water emerging from the tube 1 then forms into unstable ligaments which whirl rapidly about the axis of the tube with their lower ends oscillating upwardly and downwardly towards and away from the tube outlet. In the course of this movement, the ligament may contact the field-intensifying electrode and causes a short circuit.

It is believed that such unstable ligaments arise in the following manner. First, since the resistivity of liquids such as water and aqueous solutions is much lower than the resistivity of oil-based liquids conventionally used in spraying (about $10^6$ ohms cms. or below as compared with about $10^8$ ohm cms. or above) the liquids are rapidly charged by the electrical potential on the tube 1. Secondly, the charge within the liquid moves quickly to the surface, which becomes highly energised. In fact, the electrical energy at the surface is disruptive in the sense that every so often outwardly directed forces overcome the cohesive forces of surface tension and a charged droplet is ejected from the main volumne of liquid.

Both the main volumne of liquid and the charged droplet are believed to have an associated electrostatic field of sufficient strength to cause a corona discharge. Such a discharge may give rise to spurious changes in the charge density of the liquid, possibly causing axial and radial forces to fluctuate and to destabilise the liquid globule emerging from the tube 1, resulting in the above-described violent movement.

It is believed that the effect of the earthed pointed projections 3 in the apparatus of FIG. 1 is to cause a corona discharge between the liquid emerging from the tube 1 and the projections. Ions generated by this discharge, whose polarity is opposite to the polarity of the charge applied to the liquid, bombard the liquid and reduce the disruptive surface forces applied thereto. This reduction in disruptive forces allows the formulation of stable ligaments, and hence regular atomisation.

In the embodiment of the invention shown in FIG. 2, a tube 10 is again connected to a high voltage source (not shown) and to a container (also not shown). In this embodiment, however, a series of earthed equiangularly spaced, pointed electrodes 11 are located downstream of the outlet from the tube 10. The electrodes 11 are mounted in an inner surface of a cylinder 12 of insulating or conductive material, which is disposed coaxially of the tube 10. The cylinder 12 has an internal diameter of 3 cms. and each electrode is 0.5 cms. long. There is an axial spacing of 1 to 10 cms. between the electrodes 11 and the outlet of the tube 10.

Connected to an upper end of the cylinder 12 is a blower 13.

Figure 2:
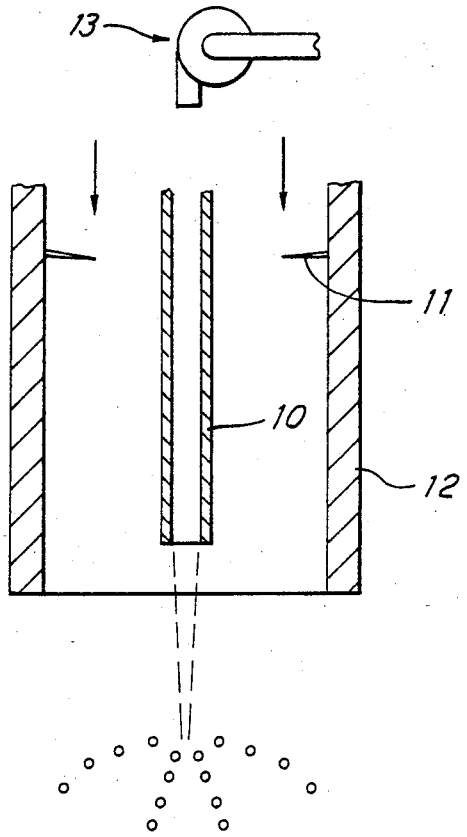
FIG. 2 is a diagrammatic axial section of a second spraying apparatus according to the invention.

In use of the apparatus of FIG. 2, the high voltage source is energised, the electrodes 11 are maintained at earth potential, and liquid is supplied from the reservoir to the tube 10. The potential difference between the tube 10 and the electrodes 11 causes a corona discharge in which gaseous ions are generated. These ions are swept downwardly through the cylinder by a stream of air (indicated by arrows in FIG. 2) from the blower. When the ions reach the vicinity of the tube outlet, they are attracted towards liquid emerging from the outlet, serving to reduce the electrical forces applied to the surface of the liquid and to result in the formation of stable ligaments, as described above.

The present invention may be applied to the spraying of a variety of liquids such as solutions of agricultural chemicals (which are often conveniently made in aqueous media) or coating compositions. Such liquids may have resistivities which range from $10^6$ ohm cms. (pure distilled water) down $10^4$ ohm cms. (tap water) or even 50 ohm cms. The liquids may be alcohol or other liquid or low resistivity (less than $10^6$ ohm cms.).

Other designs of sprayhead may be used eg. sprayheads with annular slots or slits.

Figure 3:
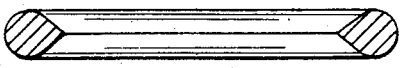
FIG. 3 is a diagrammatic axial section of a modified electrode.

Instead of pointed electrodes it is possible to use an electrode having a sharp edge. For example, the ring 2 and projections 3 of FIG. 1 could be replaced by a ring having a radially inner edge bevelled 2', as shown in FIG. 3.

Sprayheads may also include field-adjusting electrodes adjacent to the sprayhead and maintained at a different potential, as described in our U.K. Pat. No. 1 569 707. It will be understood by those skilled in the art that these electrodes perform a completely different function (normally intensifying the electrical field in the vicinity of the sprayhead) from the needle-shaped projections of the present invention.

I claim:

1. A process for the electrostatic spraying of a liquid having a resistivity of $10^6$ ohms. cms. or below, comprising delivering the said liquid to a sprayhead, applying a high electrical potential to the sprayhead so that liquid is projected from the sprayhead under the influence of electrostatic forces, and applying an electrical potential to at least one electrode adjacent the sprayhead so that a corona discharge is produced, the said at least one electrode being so arranged that ions from the discharge bombard liquid emerging from the sprayhead before the liquid has been atomised, and the strength of the generally radially directed electrical forces acting upon the surface of the emerging liquid is reduced, whereby the liquid assumes a stable ligamentary form.

2. Apparatus for the electrostatic spraying of a liquid having a resistivity of $10^6$ ohms. cm. or below, comprising a sprayhead, means for applying a high electrical potential to the sprayhead so that liquid supplied to the sprayhead is projected from the sprayhead under the influence of elecrostatic forces, at least one electrode having a sharp edge or point, and means for maintaining the said at least one electrode at an electrical potential such that a corona discharge is produced, the arrangement of the said at least one electrode being such that ions generated by the discharge bombard liquid emerging from the sprayhead before the liquid has been atomised, and the generally radially directed elecrical forces acting upon the surface of liquid are reduced whereby the emerging liquid assumes a stable ligamentary form.

3. Apparatus as claimed in claim 2, wherein the said at least one electrode is arranged adjacent to an outlet of the sprayhead from which the liquid is projected.

4. Apparatus as claimed in claim 3, wherein the said at least one electrode comprises a plurality of pointed electrodes, each electrode pointing in a direction having a component which extends radially inwardly towards the liquid and a component which extends downstream of the flow of liquid from the sprayhead.

5. Apparatus as claimed in claim 4, wherein each pointed electrode is a needle-shaped projection on a conductive ring which is disposed coaxially of the sprayhead.

6. Apparatus as claimed in claim 3, wherein the said at least one electrode comprises a ring which is disposed coaxially of the sprayhead and has a sharp radially inner edge.

7. Apparatus as claimed in claim 2, wherein the said at least one electrode is arranged adjacent to the sprayhead, upstream of an outlet from which the liquid is projected.

8. Apparatus as claimed in claim 7, further comprising means for directing a flow of gaseous ions, generated in the vicinity of the said at least one electrode, in a downstream direction towards liquid which is projected from the outlet.

9. Apparatus as claimed in claim 2, wherein the means for maintaining the said at least one electrode at an electrical potential comprise means for applying to the electrode a high potential of opposite polarity to the polarity of the potential applied to the sprayhead.

10. Apparatus as claimed in claim 2, wherein the means for maintaining the said at least one electrode at an electrical potential comprise means for maintaining the electrode at earth potential or at a potential which is low relative to the potential applied to the sprayhead.

* * * * *